US008281952B2

(12) United States Patent
Robellard et al.

(10) Patent No.: US 8,281,952 B2
(45) Date of Patent: Oct. 9, 2012

(54) RESEALABLE CONTAINERS HAVING INTERNAL ROLLER SURFACE

(75) Inventors: James R. Robellard, Antioch, IL (US); Steven D. Person, Ham Lake, MN (US); Gary F. Prokop, Wheaton, IL (US); Randall P. Bell, River Forest, IL (US); Mark D. Kiel, Bensenville, IL (US); Allen B. McKittrick, Naperville, IL (US)

(73) Assignee: Valspar Sourcing, Inc., Minneapolis, MN (US)

( * ) Notice: Subject to any disclaimer, the term of this patent is extended or adjusted under 35 U.S.C. 154(b) by 1995 days.

(21) Appl. No.: 10/758,626

(22) Filed: Jan. 15, 2004

(65) Prior Publication Data

US 2004/0226958 A1 Nov. 18, 2004

Related U.S. Application Data

(60) Provisional application No. 60/440,582, filed on Jan. 16, 2003.

(51) Int. Cl.
*B65D 25/06* (2006.01)

(52) U.S. Cl. ..... 220/570; 220/501; 220/531; 220/527

(58) Field of Classification Search ..... 220/570, 220/501, 503, 505, 572, 531, 529, 527
See application file for complete search history.

(56) References Cited

U.S. PATENT DOCUMENTS 2,659,096 A 11/1953 Mencfeldowski, Jr.
2,659,917 A * 11/1953 Drum ..... 15/257.06
2,698,450 A 1/1955 Mack
2,705,334 A 4/1955 Farrow
2,777,142 A 1/1957 LoVerde
2,827,648 A 3/1958 Geisz
3,732,593 A 5/1973 Habostad
3,761,995 A 10/1973 Rinard
3,825,970 A * 7/1974 Hanssen ..... 15/230.11
3,828,389 A 8/1974 Heisler (Continued)

FOREIGN PATENT DOCUMENTS

DE 43 14 465 A1 11/1994

(Continued)

OTHER PUBLICATIONS

"Ropak Packaging Home Page" [online]. Ropak Packaging, Fullerton, CA, 2002 [retrived on Jul. 13, 2004]. Retrieved from the Internet: <URL: www.ropakcorp.com/lpg/lpacpub01.nsf/Content/RPK_Ropak_Homepage>; 1 pg.

(Continued)

*Primary Examiner* — Stephen Castellano

(74) *Attorney, Agent, or Firm* — Mueting Raasch & Gebhardt, P.A.

(57) ABSTRACT

A container incorporating an integral roller surface for use with a roller-type liquid applicator. The roller surface may be movable from a first, operational position to a second, access position. The floor of the container may be sloped so that a well forms at a particular location, e.g., at or near one end of the container. The roller surface preferably provides access to the well during use. When the roller surface is moved to the second, access position, the sloped floor of the container may provide a second roller surface.

23 Claims, 17 Drawing Sheets

U.S. PATENT DOCUMENTS

| | | | | | |
|---|---|---|---|---|---|
| 3,837,035 | A | | 9/1974 | Habostad | |
| D246,439 | S | | 11/1977 | Lynn et al. | |
| 4,107,815 | A | | 8/1978 | Dumesnil, Jr. | |
| 4,200,949 | A | | 5/1980 | Heniff, Jr. | |
| 4,893,723 | A | | 1/1990 | Seabolt | |
| 4,928,843 | A | | 5/1990 | Gunderson | |
| 5,085,317 | A | | 2/1992 | Jensen et al. | |
| 5,314,061 | A | | 5/1994 | Bedrossian | |
| 5,341,969 | A | | 8/1994 | Accardo et al. | |
| 5,400,916 | A | | 3/1995 | Weber | |
| 5,404,611 | A | | 4/1995 | Raney | |
| 5,472,111 | A | | 12/1995 | Renfrew | |
| 5,489,051 | A | | 2/1996 | Robinson | |
| 5,533,228 | A | | 7/1996 | Jarecki et al. | |
| 5,727,708 | A | | 3/1998 | Erickson | |
| 5,810,196 | A | | 9/1998 | Lundy | |
| 5,893,489 | A | | 4/1999 | Giarrante | |
| 5,975,346 | A | | 11/1999 | Imperato et al. | |
| 5,992,106 | A | * | 11/1999 | Carling et al. | 52/177 |
| 6,019,241 | A | | 2/2000 | Burns | |
| 6,102,235 | A | | 8/2000 | Stern et al. | |
| 6,199,718 | B1 | | 3/2001 | Ellis | |
| 6,269,967 | B1 | | 8/2001 | de Vries | |
| 6,412,661 | B1 | | 7/2002 | Hannah, Sr. | |
| D518,265 | S | | 3/2006 | Prokop et al. | |
| D524,003 | S | * | 6/2006 | Prokop et al. | D32/53.1 |
| D524,501 | S | * | 7/2006 | Prokop et al. | D32/53.1 |
| 2001/0050284 | A1 | * | 12/2001 | Jaeger | 220/571 |
| 2003/0074760 | A1 | * | 4/2003 | Keller | 15/230.11 |

FOREIGN PATENT DOCUMENTS

| | | | |
|---|---|---|---|
| EP | 1293360 | A1 | 3/2003 |
| FR | 2087688 | | 12/1971 |
| FR | 2087688 | A | 12/1971 |
| WO | 03091123 | A1 | 11/2003 |

OTHER PUBLICATIONS

"Square Containers" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__product__type2>; 1 pg.

"2.1-Gallon Square Container (S026)" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__square__S026>; 1 pg.

"2.1-Gallon Square Container (SA26)" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__square__SA26>; 1 pg.

"EZ Stor Containers" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__product__type3>; 1 pg.

"1-Gallon EZ Stor Container (E015)" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__EZStor__E015>; 1 pg.

"2-Gallon EZ Stor Container" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__EZStor__E027>; 1 pg.

"3-Gallon EZ Stor Container" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__EZStor__E037>; 1 pg.

* cited by examiner

RESEALABLE CONTAINERS HAVING INTERNAL ROLLER SURFACE

RELATED APPLICATIONS

This application claims the benefit of U.S. Provisional Application No. 60/440,582, filed Jan. 16, 2003, which is incorporated herein by reference in its entirety.

TECHNICAL FIELD

The present invention relates generally to containers and methods of using same and, more particularly, to a container for liquids, e.g., paint, wherein the container includes an integral roller surface.

BACKGROUND

The use of nap rollers (also referred to herein as roller-type applicators) for applying liquids like paint to large areas such as walls or ceilings is well known in both commercial and consumer ("do it yourself" or "DIY") markets. Generally speaking, these rollers are used in conjunction with a paint roller tray. Paint roller trays are generally rectangular in shape and include a floor configured as an inclined roller surface. The inclined surface typically terminates at a paint well at one end of the tray. During use, the paint roller tray is filled with paint from a paint container. A paint roller may be dipped into the paint well and rolled back and forth across the inclined roller surface. This rolling action not only removes excess paint from the paint roller surface, but also distributes paint more evenly on the roller. The paint roller may then be rolled across a paintable surface, whereby paint is transferred thereto.

While rollers are used heavily by commercial painters, the use of paint roller trays is perceived, at least in some segments of the DIY market, to have potential drawbacks. For example, paint roller trays generally require pouring paint from an original paint container into the paint roller tray prior to use. Yet, pouring paint from the original paint container to the tray may result in accidental paint spillage and/or splashing. Moreover, many paint cans and buckets are not shaped optimally for pouring. As a result, the step of pouring paint often results in a certain quantity of paint dripping down the side of the container. At the completion of a painting project, the excess paint in the tray is generally discarded or returned to the original paint container. Again, this transfer of paint may result in unintended spillage.

Another problem with traditional paint rolling is related to cleaning and storage of paint roller trays. For example, in order to ensure the tray is available for subsequent uses, the tray must typically be cleaned after each use. However, cleaning wet, dry, and/or partially dried paint from the tray surfaces can be messy. In fact, in some situations, consumers may dispose of the tray altogether rather than clean it.

SUMMARY

The present invention is directed to a resealable container having an internal roller surface and a method of using such a container. The roller surface is advantageous for distributing liquid, e.g., paint, onto a roller-type applicator. Containers in accordance with the present invention provide a convenient and stable container in which liquid may be shipped. In addition, containers and methods of the present invention permit rolling liquid without the need to first transfer liquid to a conventional roller tray.

In one embodiment, a container is provided. The container includes a container body having a sloped floor and at least one sidewall. The sloped floor and the at least one sidewall define a reservoir operable to hold a designated volume of liquid. The container also includes a first roller surface movably coupled to the container body, wherein, when the first roller surface is in a first position, a substantial portion of the first roller surface is located above the designated volume of liquid. In some embodiments, a lowermost portion of the first roller surface is located above the designated volume of liquid.

In another embodiment, a method of applying liquid from a container to a roller-type applicator is provided. The method includes dipping the roller-type applicator into the liquid in the container. The container may have a sloped floor and at least one sidewall defining a reservoir operable to hold a designated volume of the liquid. The method further includes rolling the applicator across a roller surface coupled to the container. A substantial portion of the roller surface is, when in a first position, located above a level of the designated volume of the liquid.

In yet another embodiment, a container is provided and includes a container body defining a partially enclosed reservoir having an open top. The reservoir is operable to hold a designated volume of liquid. A first roller surface is also included and coupled to the container body, wherein a substantial portion of the first roller surface is, when in a first position, located at a level above the designated volume of liquid.

The above summary of the invention is not intended to describe each embodiment or every implementation of the present invention. Rather, a more complete understanding of the invention will become apparent and appreciated by reference to the following detailed description in view of the accompanying figures of the drawing.

BRIEF DESCRIPTION OF THE FIGURES

The present invention will be further described with reference to the figures of the drawing, wherein.

DETAILED DESCRIPTION OF EXEMPLARY EMBODIMENTS

Figure 1:
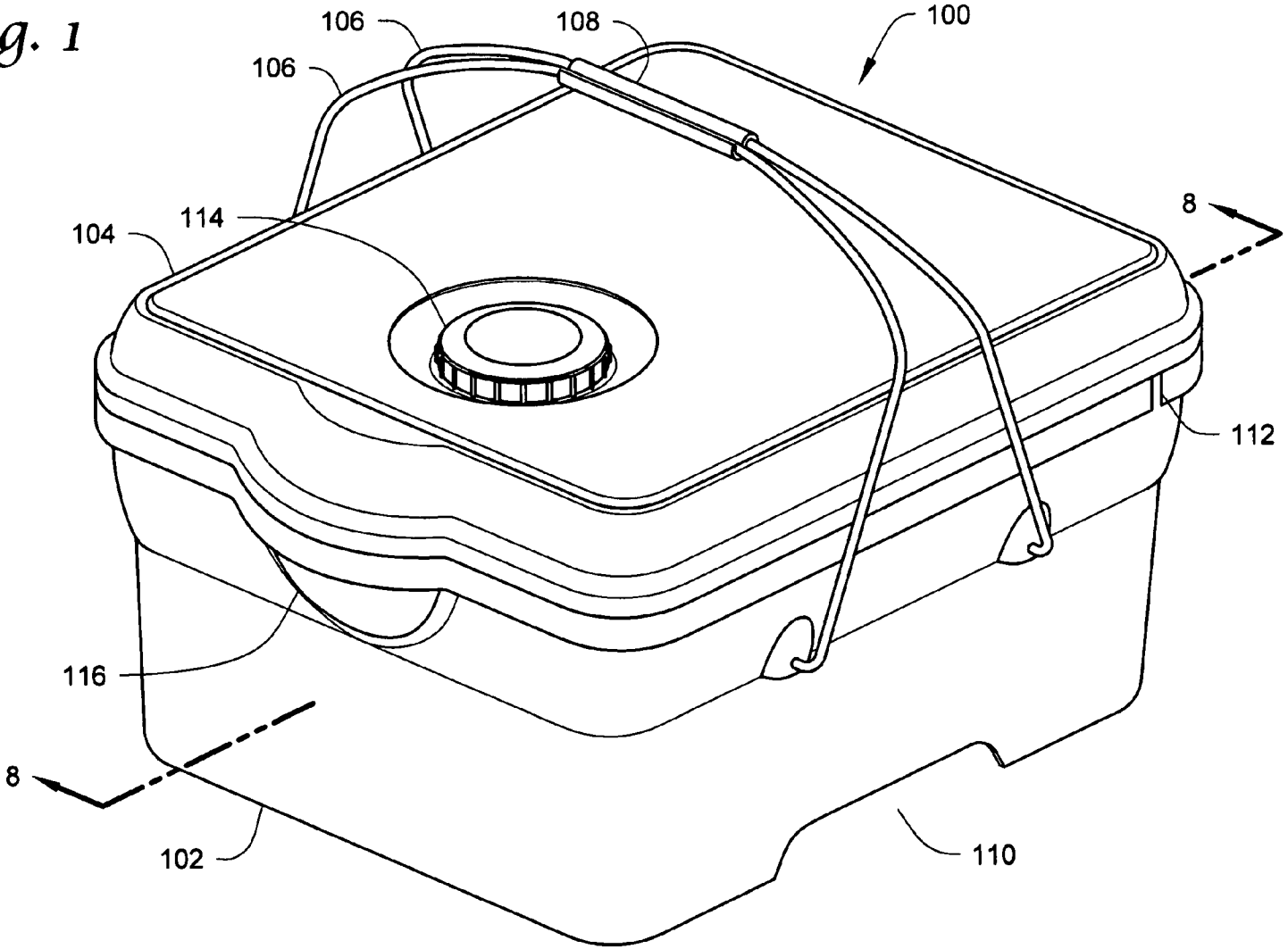
FIG. 1 is a perspective view of a container for holding a liquid, e.g., paint, in accordance with one embodiment of the present invention, the container shown in a closed configuration.

In the following detailed description of exemplary embodiments, reference is made to the accompanying figures of the drawing that form a part hereof, and in which are shown by way of illustration specific embodiments in which the invention may be practiced. It is to be understood that other embodiments may be utilized and structural changes may be made without departing from the scope of the invention.

Generally speaking, the present invention is directed to a resealable container having a lid or lid portion that is at least partially separable from a body or body portion. The body may form an open top reservoir operable to hold up to a designated volume of liquid, e.g., paint. When the lid is removed or otherwise separated from the body, the interior reservoir is accessible.

As used herein, the phrase "designated volume of liquid" or "designated level of liquid" indicates a predetermined maximum volume or level of liquid that the container is designed or otherwise intended to hold, e.g., the volume of liquid that is provided with the container at the point of sale. The actual volume that the container may hold is, most likely, greater than the designated volume of liquid.

The containers and methods of the present invention are described herein in the context of paint. However, this usage is illustrative only. In fact, those of skill in the art will realize that containers and methods of the present invention may be utilized with most any liquid, e.g., paints, stains, floor coatings, adhesives, sealants, mastics, etc., without departing from the scope of the invention.

Coupled to the body at a level preferably at or above the designated level of liquid, is a roller apparatus incorporating at least a roller surface. Preferably, the roller surface is discontinuous. For example, the roller surface may include a perforated surface (such as a screen or grate) and/or a surface having protrusions or other surface variations that assist in distributing liquid over a roller-type liquid applicator, e.g., a paint roller. As a result, containers in accordance with the present invention may eliminate the need for separate equipment, e.g., may eliminate the need for a separate roller tray.

In some embodiments, the roller apparatus, e.g., the roller surface, is movably coupled to the container body. For example, in the illustrated embodiments, the roller surface is movable relative to the container body by pivoting relative thereto. However, while illustrated and described herein as having a pivotal connection, the term "movably coupled" is intended to include most any container configuration that allows coupling of the roller surface to the container while still permitting selective movement of the roller surface relative to the container. For instance, the roller surface may be translatable or both translatable and pivotable relative to the container body. Alternatively, the roller surface may simply couple to and decouple from the container body, e.g., hang or suspend from an upper lip of the body.

To accommodate the shape of a conventional roller-type applicator, containers in accordance with the present invention may have a generally rectangular plan shape, e.g., rectangular footprint. However, other shapes are certainly possible. Moreover, while container capacities of about one to about ten gallons, more preferably about two to about three gallons, are contemplated, containers of most any size may be made without departing from the scope of the invention.

Containers in accordance with the present invention provide several advantages over conventional liquid containers and their associated roller trays. For example, no separate roller tray is required. Thus, setup and cleanup time may be reduced. The present containers also have a relatively low center of gravity, and thus are stable during shipment and subsequent use. Furthermore, the containers described herein hold a relatively large quantity of liquid (e.g., two to three gallons), reducing or eliminating the need to frequently replenish the liquid supply as is common with conventional roller trays. Containers as described herein may also be reusable. Other advantages will become apparent from the following description.

FIG. 1 illustrates an exemplary container 100 in accordance with one embodiment of the present invention. The container 100 includes a body 102 forming an open top reservoir operable to hold a designated volume of liquid, e.g., paint. The open top of the body 102 may be selectively covered and substantially sealed with a removable lid 104. In the embodiment illustrated in FIGS. 1-3, the lid 104 may form a relatively tight seal with the body 102 such that liquid may be shipped and stored in the container 100. When the lid 104 is removed (see FIG. 3), the interior reservoir of the body 102 is accessible.

The container 100 may optionally include one or more, and preferably two, handle or handle members 106 to permit carrying. Suitable handles 106 may be made from metal, e.g., wire, and/or plastic materials. The handles 106 may interlock (e.g., snap together) with a gripping portion 108 to provide a comfortable gripping surface. Preferably, the container 100 is also configured to allow stacking of multiple containers, e.g., for shipping, storage, and display. As a result, the handles 106 may be configured to pivot downwardly (see FIG. 2). Pivoting the handles 106 downwardly allows not only stacking of multiple containers 100, but also permits unimpeded access to the container 100 once the lid 104 is removed.

To allow lifting of the container 100 without use of the handles 106, the body 102 may also include cutouts 110. The cutouts 110 are sized to permit a user's hands to lift the container 100 from underneath the body 102. The underside of the body 102 may further include one or more ribs 111 (see FIG. 2) or other support structure. The ribs 111 may provide increased ground contact and improved container stability. Other handles or cutouts, as well as other rib configurations, may also be included without departing from the scope of the invention.

The lid 104 may optionally include a resealable access opening 114 that permits access to the container 100, e.g., to the liquid therein, without removal of the lid 104. Such access is advantageous for various purposes including, for example, tinting and/or sampling of liquid such as paint at the point of sale.

In the illustrated embodiments, the container body 102 and lid 104 are made of plastic (although other materials, e.g., metals, may be used) and may seal to one another with what is commonly referred to as a snap fit. A sealing member, e.g., an O-ring or gasket (not shown), may be included to improve sealing integrity. Alternatively, the snap fit of the lid 104 to the body 102 (see FIGS. 8 and 9) may be sufficient to seal the contents of the container 100.

To provide greater seal integrity during shipment, the lid 104 may also include a removable lip or tear strip 112 (FIG. 1) surrounding a portion of the perimeter of the lid 104. With the tear strip 112 in place, the lid 104 is substantially secured to the container 100. However, once the tear strip 112 is torn or otherwise removed from the lid 104, the lid may be easily removed and resealably reattached, e.g., it may be removed and then re-secured with a snap fit.

Figure 2:
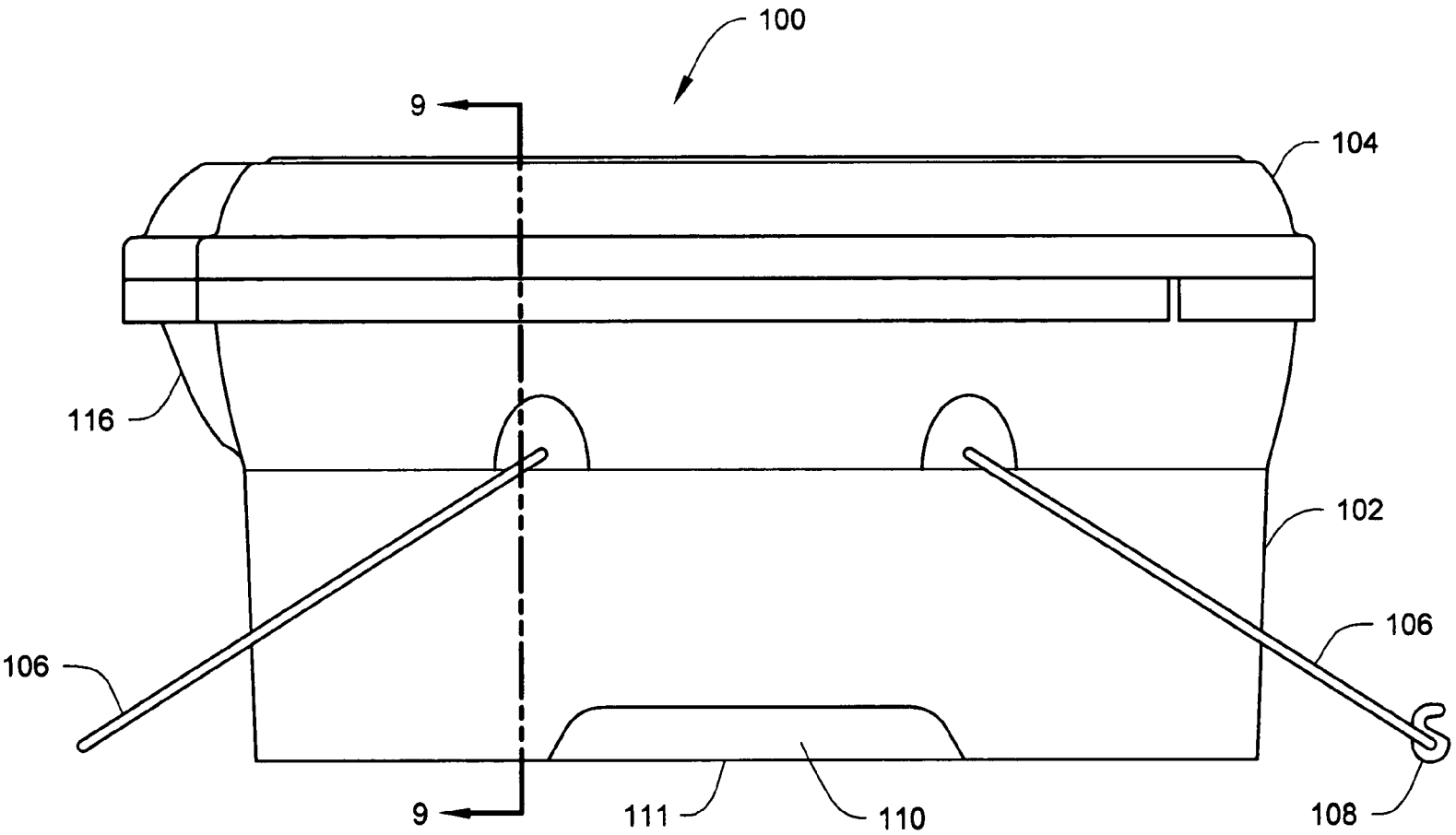
FIG. 2 is a side elevation view of the container of FIG. 1 with its handles repositioned.

FIG. 2 illustrates a side elevation view of the container 100 of FIG. 1 with the handles 106 pivoted downwardly. The cutouts 110 are clearly illustrated in this view. An optional pour spout 116 is also illustrated and may be included with any of the embodiments described herein to assist in pouring liquid from the container 100.

Figure 3:
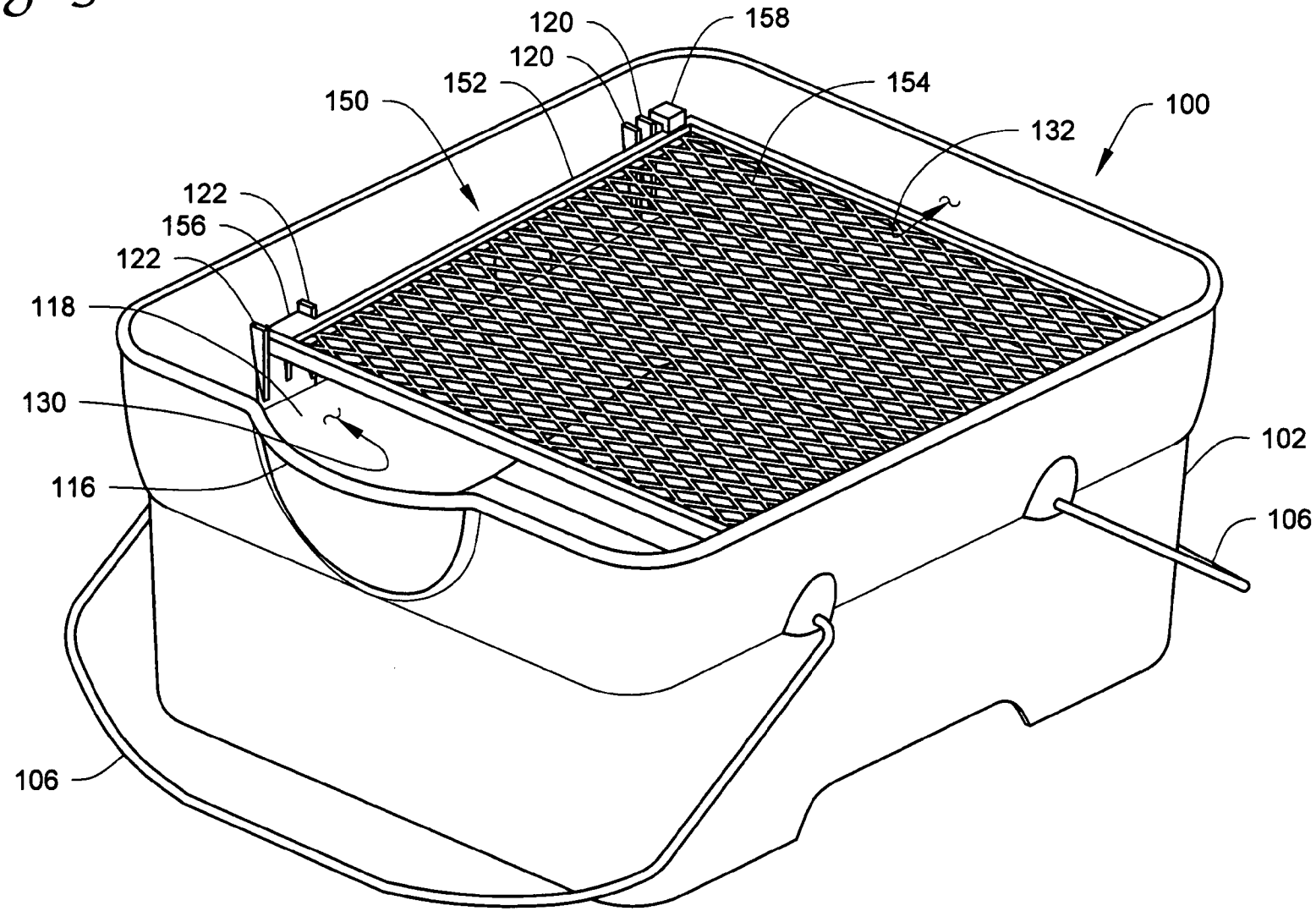
FIG. 3 is a perspective view of the container of FIG. 1 with the container shown in an open configuration (with the lid removed), and an exemplary roller apparatus shown in a first position, the roller apparatus having a roller surface.

FIG. 3 illustrates the container 100 in an open configuration, e.g., with the lid 104 removed. In this view, a roller apparatus 150 is shown in a first operational position. The apparatus 150 may include a roller surface 154 optionally supported by a frame 152. The surface 154 may be formed by a screen made from a preferably non-rusting material, e.g., plastic or a metal such as aluminum. However, other perforated and non-perforated roller surface configurations/materials are also contemplated. For instance, a slanted-from-horizontal surface having a series of protrusions, e.g., chevrons (not shown), is possible. Preferably, the protrusions would not undesirably interfere with the flow of liquid from the roller surface 154 back into the body 102.

Figure 5:
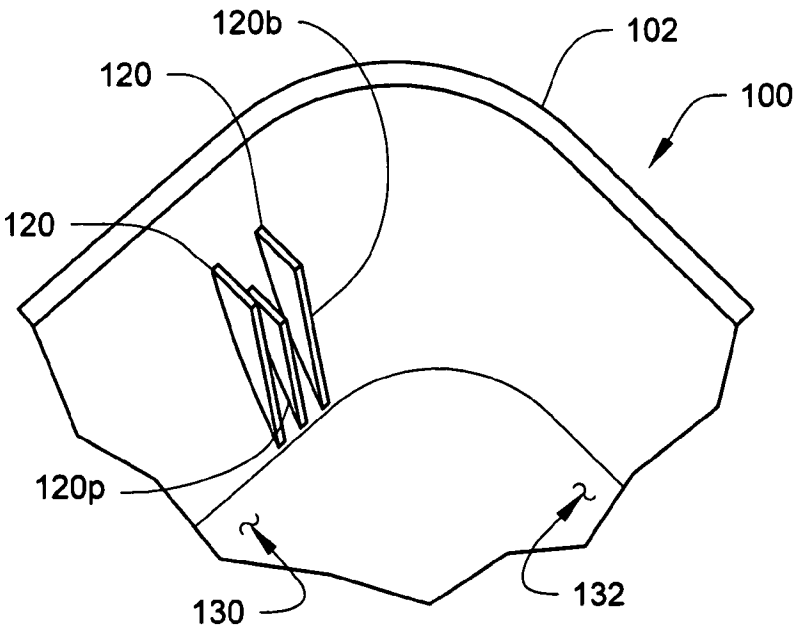
FIG. 5 is a view of the portion of the container of FIG. 4 with the roller apparatus removed for clarity.
Figure 4:
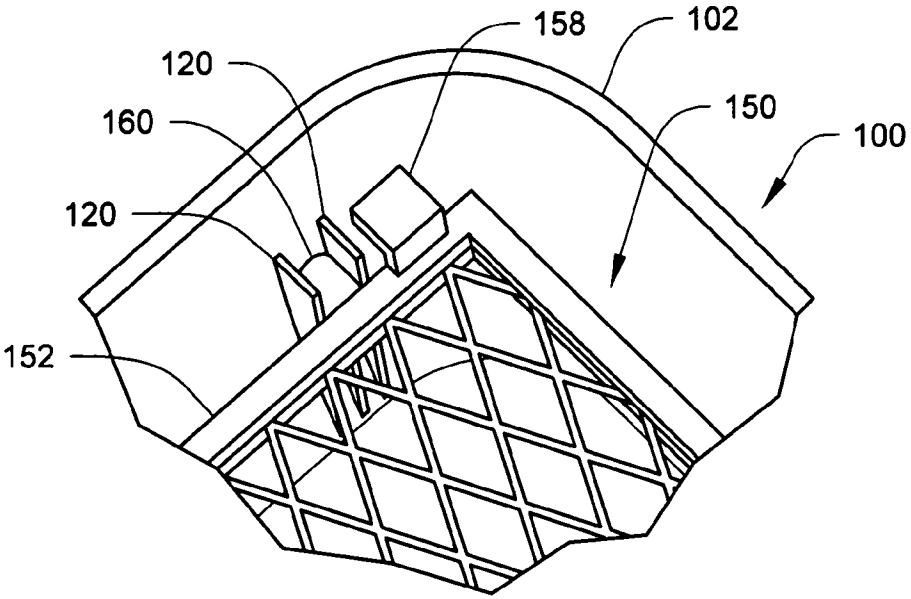
FIG. 4 is a partial enlarged view of a portion of the container of FIG. 3.

FIGS. 3-5 illustrate an exemplary structure for supporting the roller apparatus 150 within the body 102. The body 102 may include a series of preferably upstanding sidewalls 130, 132 forming two opposing pairs of sidewalls, and a lower surface or floor 134 (best viewed in FIGS. 8 and 9). To assist in retaining the roller apparatus 150 relative to the walls 130, 132, tabs 120, 122 may be included as shown in FIG. 3. The tabs 120, 122 may be integrally formed with the sidewalls 130 as shown, or may be separate components which are subsequently attached, e.g., welded, ultrasonically welded, adhered, glued, etc., to the sidewalls 130.

Although shown herein as having a generally rectangular footprint, the container 100, e.g., body 102 and lid 104, may have other shapes. For example, the container could be generally round or elliptical. In such a case, the body 102 may have only one continuous, e.g., circumferential, sidewall rather than the four distinct sidewalls illustrated herein. In such a configuration, the apparatus 150 could still be configured to span across a portion of the container as described herein.

In the illustrated embodiment, the apparatus 150 is supported in the container by pivot tabs 120 and support tabs 122 (while only one interior side of the container is shown in FIG. 3, the opposite side may be a substantial mirror image). However, other tab configurations are possible. Similarly, instead of tabs, a ledge or shelf could be provided in the sidewalls 130, 132 of the container 100 to support the apparatus 150.

Figure 8:
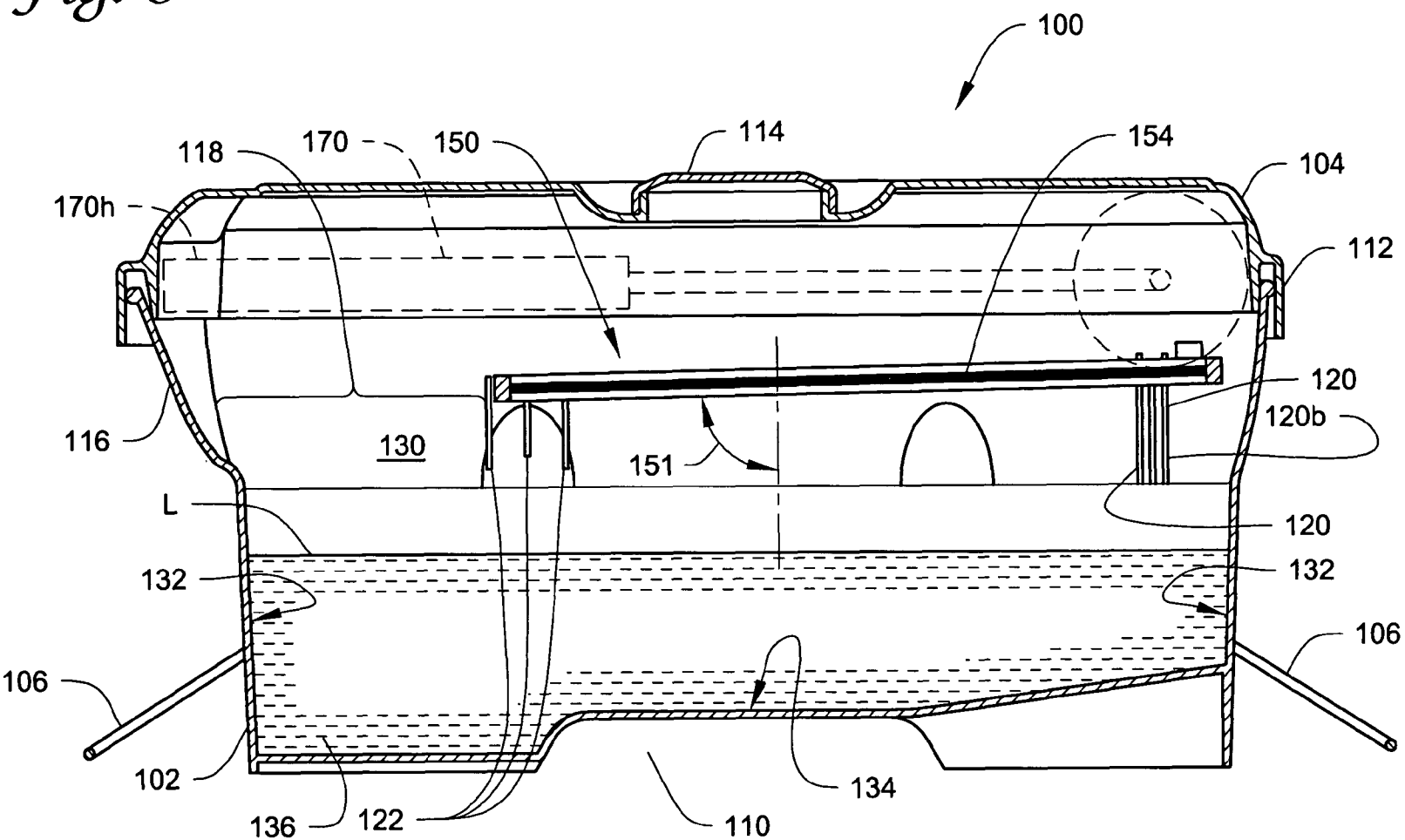
FIG. 8 is a section view taken along line 8-8 of FIG. 1 (with the handles shown down, a resealable opening shown in an alternate position and, for illustration purposes, a roller-type applicator shown within the container)

The roller surface 154 preferably spans substantially between sidewalls 130 (see FIG. 9) and extends substantially adjacent to one of sidewalls 132 (see sidewall 132 toward the right in FIGS. 3 and 8). However, the surface 154 preferably terminates at a distance away from the opposite sidewall 132 to provide an access zone 118 (see FIGS. 3 and 8). The access zone 118 permits access to the liquid inside the container 100 with a roller-type applicator as further described below.

The apparatus 150, e.g., the frame 152 or screen 154, may include tab portions 156 operable to engage the tabs 122 of the body 102 as shown in FIG. 3. Similarly, the apparatus 150 may include pin portions 160 operable to engage the pivot tabs 120 as best illustrated in FIGS. 4 and 5. Each pin 160 may engage its respective pivot tab 120 with or without a snap fit. Each pivot tab 120 may include a lower tab 120*p* (as shown in FIG. 5) to support the lower portion of the pin 160.

Figure 7:
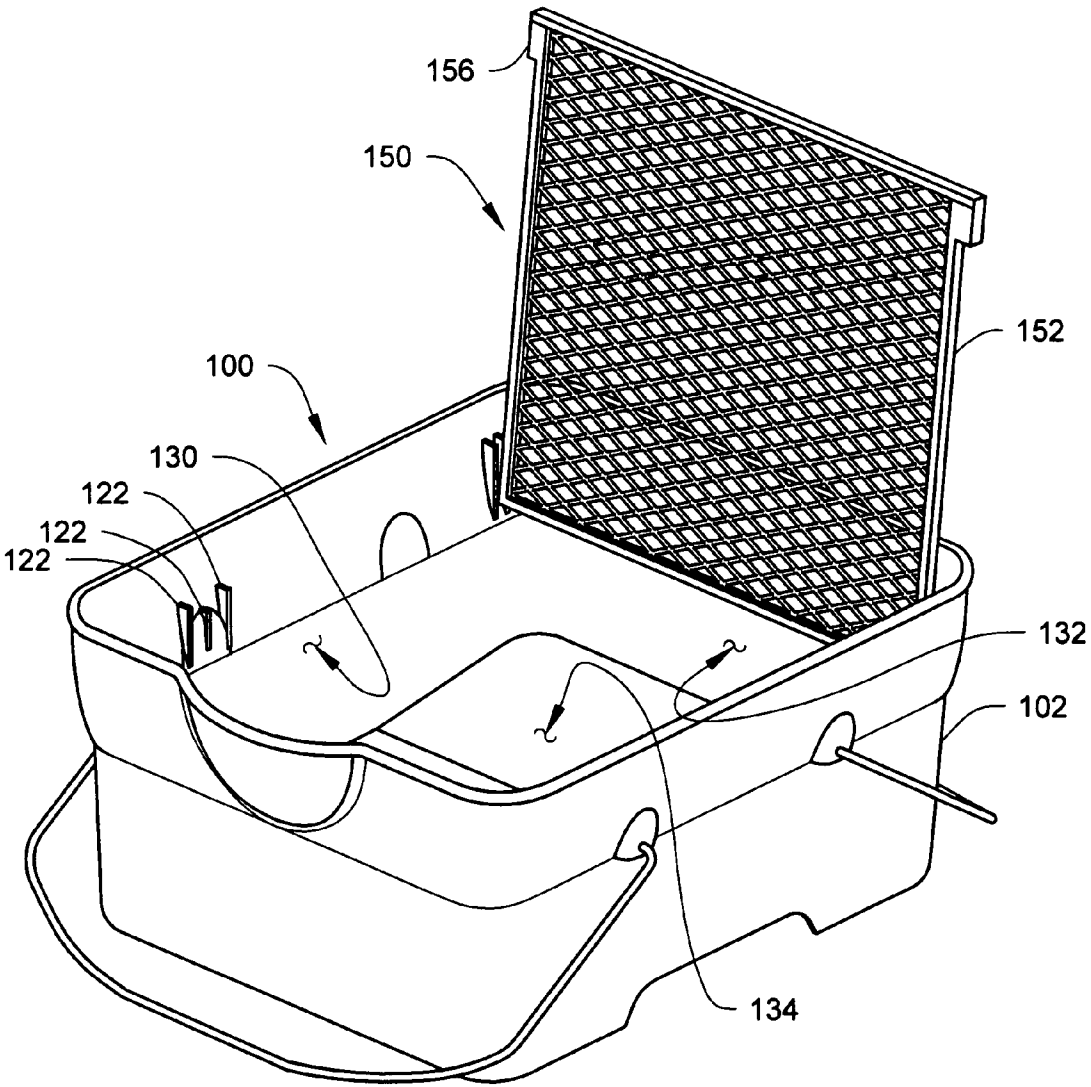
FIG. 7 is a perspective view of the container of FIG. 3, with the roller apparatus shown in a second position.

In some embodiments, the roller apparatus 150 may move, e.g., pivot, from the first position as shown in FIG. 3 to a second open position (see FIG. 7). As a result, the apparatus 150, e.g., frame 152, may optionally include a stop member 158 as shown in FIG. 4. The stop member 158 limits the arc over which the apparatus 150 may pivot about the pin 160 as further described below. In one embodiment, the stop member 158 limits travel by contacting a portion 120*b* (see FIG. 5) of the proximate tab 120 when the apparatus 150 reaches the desired position.

In the illustrated embodiments, the support tabs 122 (see FIGS. 3 and 7) form a shelf against which the tabs 156 may rest when the apparatus 150 is in the first operational position as shown in FIG. 3. The support tabs 122 may protrude above the tabs 156 as shown to provide additional stability to the apparatus 150.

Figure 6:
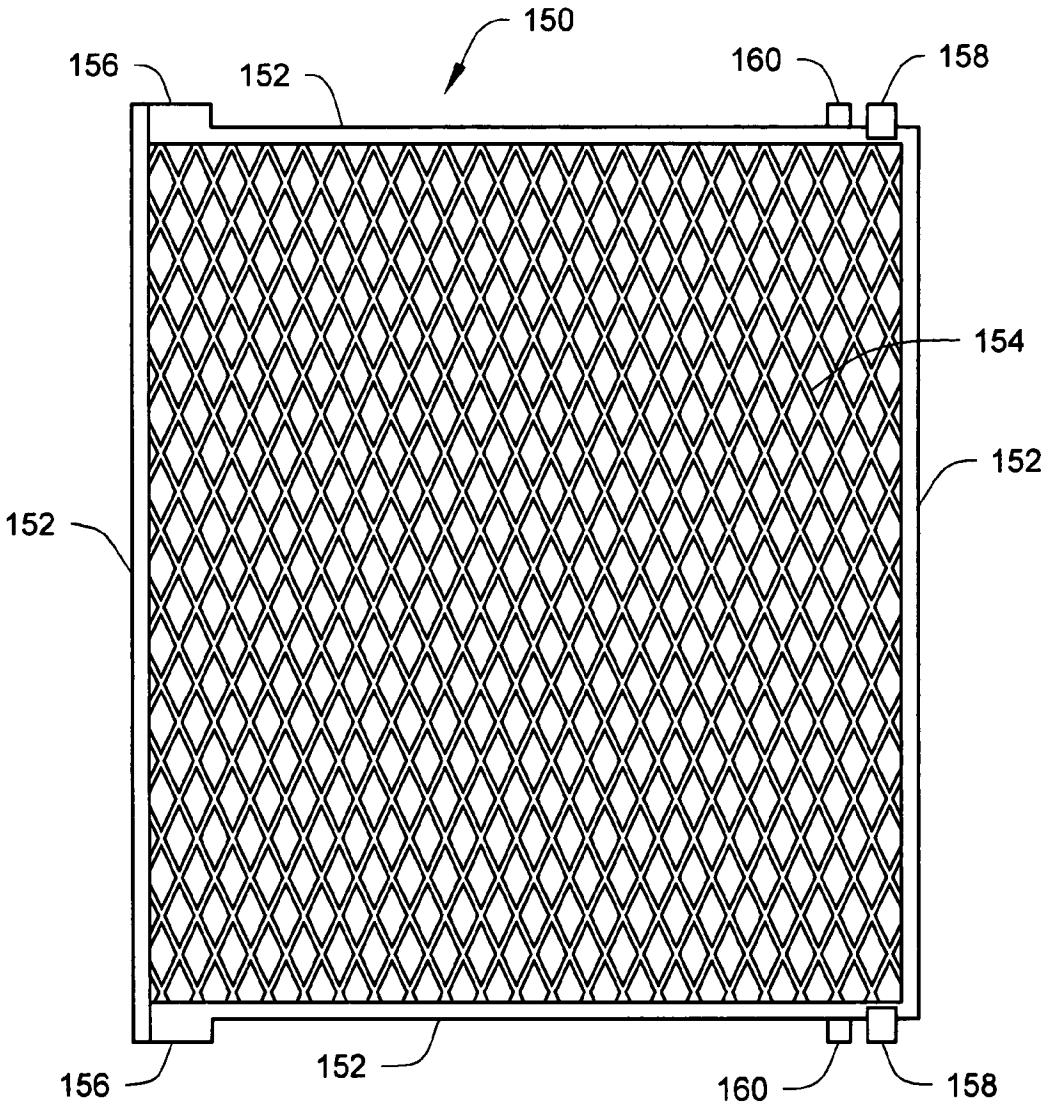
FIG. 6 is a top plan view of a roller apparatus in accordance with one exemplary embodiment of the invention.

FIG. 6 is a top plan view of the roller apparatus 150 of FIGS. 3-5. The frame 152, tabs 156, stops 158, and pins 160 are clearly illustrated in this view. In addition, the roller surface 154 is clearly shown. In this particular embodiment, the surface 154 is formed by a wire mesh or screen. The screen provides an aggressive pattern operable to adequately distribute liquid, e.g., paint, over a surface of a roller-type applicator, while not interfering with the flow of excess liquid back into the container body 102. While shown as using a screen or grid, most any surface that distributes liquid over the roller-type applicator and allows flow of excess liquid back to the container 100 is possible without departing from the scope of the invention.

Although not illustrated herein, other embodiments of the apparatus 150 in accordance with the present invention may exclude the frame 152 altogether. For example, the roller apparatus 150 may include a roller surface 154, e.g., screen or grid, sufficiently rigid so that no separate frame 152 is required.

While FIG. 3 shows the container 100 with the roller apparatus 150, e.g., surface 154, in the first or operational position, FIG. 7 illustrates the container 100 with the apparatus 150 moved, e.g., pivoted, to the second or open position. The ability to pivot the apparatus 150 to the second position allows the user to access the bottom of the body 102 when desired. Such access may be advantageous, for example, when the container 100 is almost empty. In such a case, the user may utilize the bottom surface 134 of the container 100 as a second roller surface as further described below.

The location of the second position of the roller apparatus 150 is selected to ensure that liquid dripping from the apparatus reenters the container 100 rather than dripping onto surrounding surfaces. In some embodiments, the roller apparatus 150 (e.g., the surface 154) pivots about 100 degrees or more between the first position (FIG. 3) and the second position (FIG. 7). However, other embodiments may pivot more or less as the particular container configuration requires. To control the particular location of the surface 154 when in the second position, the stops 158 (see FIG. 4) may be modified and/or relocated. While not illustrated, the roller apparatus 150, when in the second position (see FIG. 7), may include a feature(s), e.g., a notch (not shown), that allows temporary hanging of a roller-type applicator from the apparatus 150.

FIG. 8 is a section view taken along line 8-8 of FIG. 1. In this view, the orientation of the roller apparatus 150 is shown as being positioned at an angle 151 from vertical (i.e., from an imaginary vertical line substantially normal to the level of the liquid L) to assist with liquid return to the body 102. Suitable ranges for the angle 151 are about 45 to about 135 degrees. Preferably the angle 151 is about 70 to about 110 degrees, more preferably about 80 to about 100 degrees, and most preferably about 85 to about 95 degrees. FIG. 8 also illustrates an alternate position for the resealable opening 114.

Preferably, a substantial portion of the roller surface 154 is located above the designated level of liquid L in the container. In some embodiments, the roller surface 154 of the apparatus 150 may be located such that a lowermost portion of the roller surface remains above the designated level of the liquid L in the container 100.

Optionally, the uppermost portion of the roller surface 154 may be configured to remain below a corresponding portion of the lid 104 when the lid is coupled to the body 102. As a result, when the roller surface 154 is in the first position and the lid 104 is covering the open top of the body, the roller surface may be located within an enclosed space defined by the container body 102 and the lid. In some embodiments, the uppermost portion of the roller surface 154 may be below the uppermost edge of the open top of the body 102 (i.e., below the top edge of the body 102 as viewed in FIGS. 8-9). In still other embodiments, the roller surface 154 may be installable after removal of the lid. In the case of the latter, the uppermost portion of the roller surface 154 may be at most any elevation.

FIG. 8 also illustrates an exemplary embodiment of the floor 134 of the body 102. A well 136 may be formed to collect liquid L proximate one end of the container, e.g., below the access zone 118. In the illustrated embodiment, at least a portion of the floor 134 may be sloped as shown to allow Liquid L to flow towards the well 136. By keeping liquid in the well 136, the user may wet the roller-type applicator more easily through the access zone 118 during use without the need to tip or otherwise manipulate the container 100.

The floor 134 may also, as mentioned above, be used as a second roller surface, e.g., a sloped surface having protrusions, so that, as the volume of liquid L gets low, the actual floor 134 may be utilized as a second roller surface. Alternatively, the floor 134 may form a relatively smooth second roller surface. Similarly, while the floor 134 may be sloped and/or include the well 136 to assist in pooling of the liquid, other embodiments may use a generally horizontal floor.

In certain embodiments, the roller apparatus 150 may be configured to hold a standard size roller-type applicator 170, e.g., paint roller, in a generally horizontal position at a level above that of the Liquid L when the lid 104 is attached (see FIG. 8). The optional pour spout 116 may be utilized to support a portion, e.g., a handle **170*h*, of the applicator 170 in this stored position. Other embodiments of the container 100** may include provisions to support a stir stick (not shown) either inside or outside the container.

Figure 9:
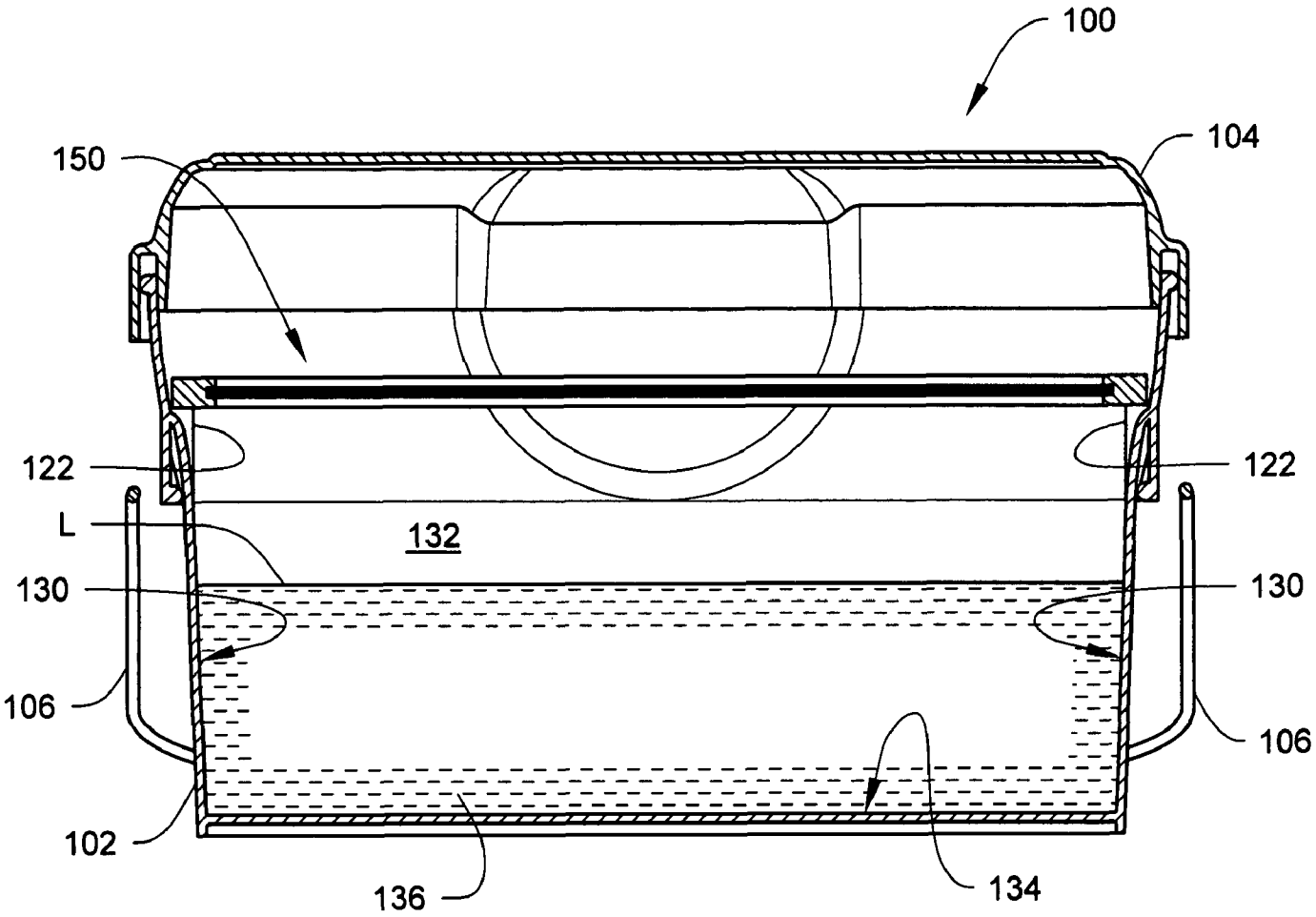
FIG. 9 is a section view taken along line 9-9 of FIG. 2 (with the handles shown down)

FIG. 9 is a section view taken along line 9-9 of FIG. 2, showing the sidewalls 130, 132 and the floor 134 in the vicinity of the well 136. The apparatus 150 is also illustrated in this view.

Figure 10:
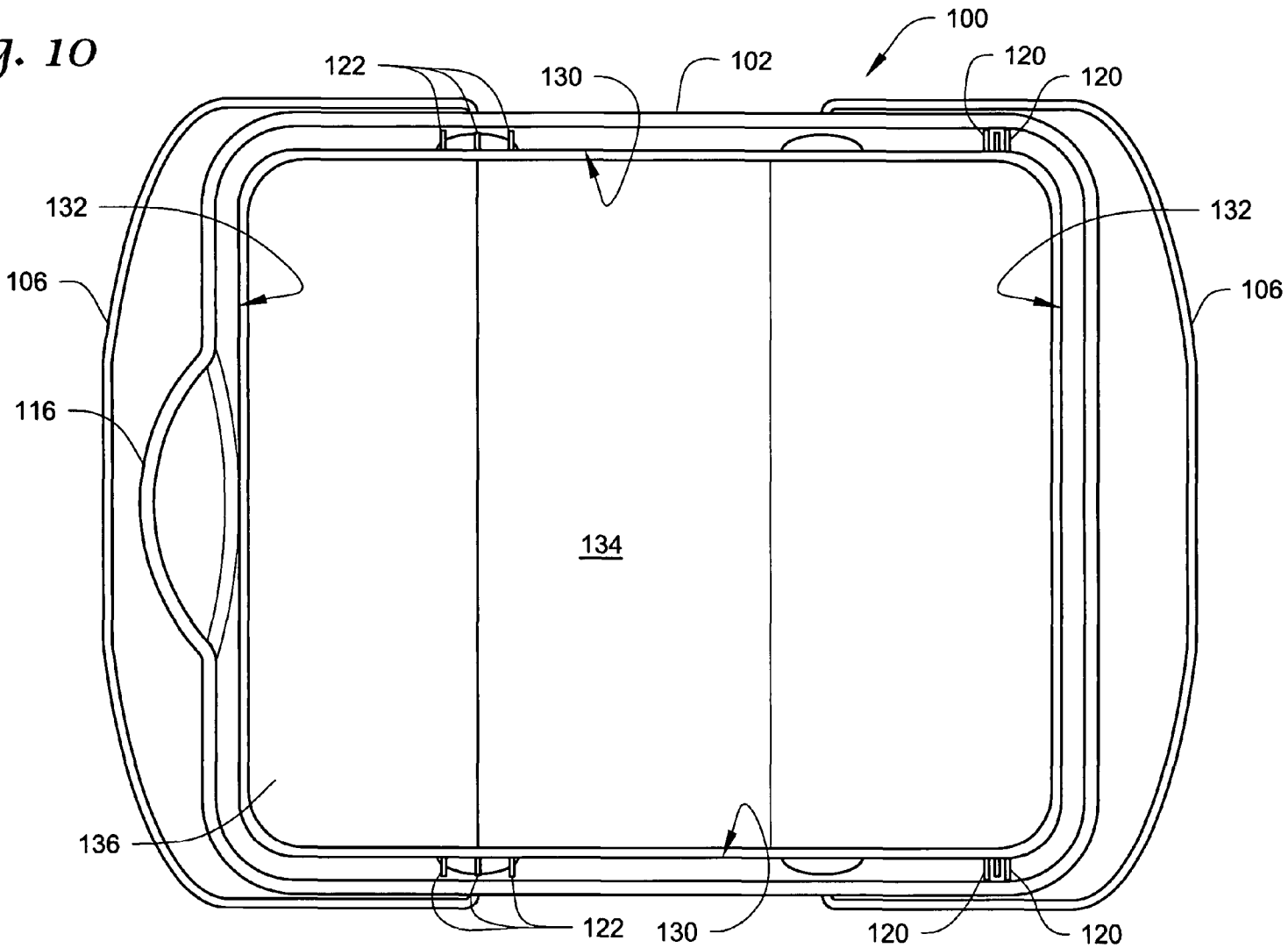
FIG. 10 is a top plan view of the container of FIG. 3 with the roller apparatus removed for clarity.

FIG. 10 is a top plan view of the container 100 with the lid 104 and roller apparatus 150 removed. While the sidewalls 130, 132 are illustrated as relatively straight and substantially vertical in these views, other configurations e.g., containers having more angular or curved sidewalls, are certainly possible without departing from the scope of the invention. Where the container body 102 is molded, at least a shallow draft may be preferred.

In use, sampling and tinting of the liquid within the container 100 may be conducted through the access opening 114 at the point of sale or elsewhere. The opening 114 may also be used to pour liquid into another container (while the lid 104 is still attached) or to allow a siphon to access the container (e.g., for a liquid sprayer). To apply the liquid within the container 100, the user may remove the lid 104 (assuming the optional tear strip 112 has been removed) from the container body 102 and stir the liquid (if necessary). A roller-type applicator (see, e.g., applicator 170 in FIG. 8) may then be dipped into the Liquid L through the access zone 118 (see FIG. 8) and rolled across the roller surface 154 of the roller apparatus 150 in a manner similar to that used with a typical roller tray. As liquid L is distributed over the cylindrical surface of the applicator 170, excess liquid L may returns to the container body 102 by dripping through the perforated surface 154 and/or running down the optionally sloped face of the surface.

As the volume of Liquid L in the body 102 is reduced, the user may pivot the surface 154 from the first position (see FIG. 3) to the second position (see FIG. 7) such that the floor 134 of the container body 102 is more accessible for use as an optional second roller surface, e.g., the roller applicator may be rolled across the floor 134. Alternatively, additional liquid may be added from another container. When liquid application is completed, the container 100 may be resealed to preserve any remaining liquid L.

Figure 11:
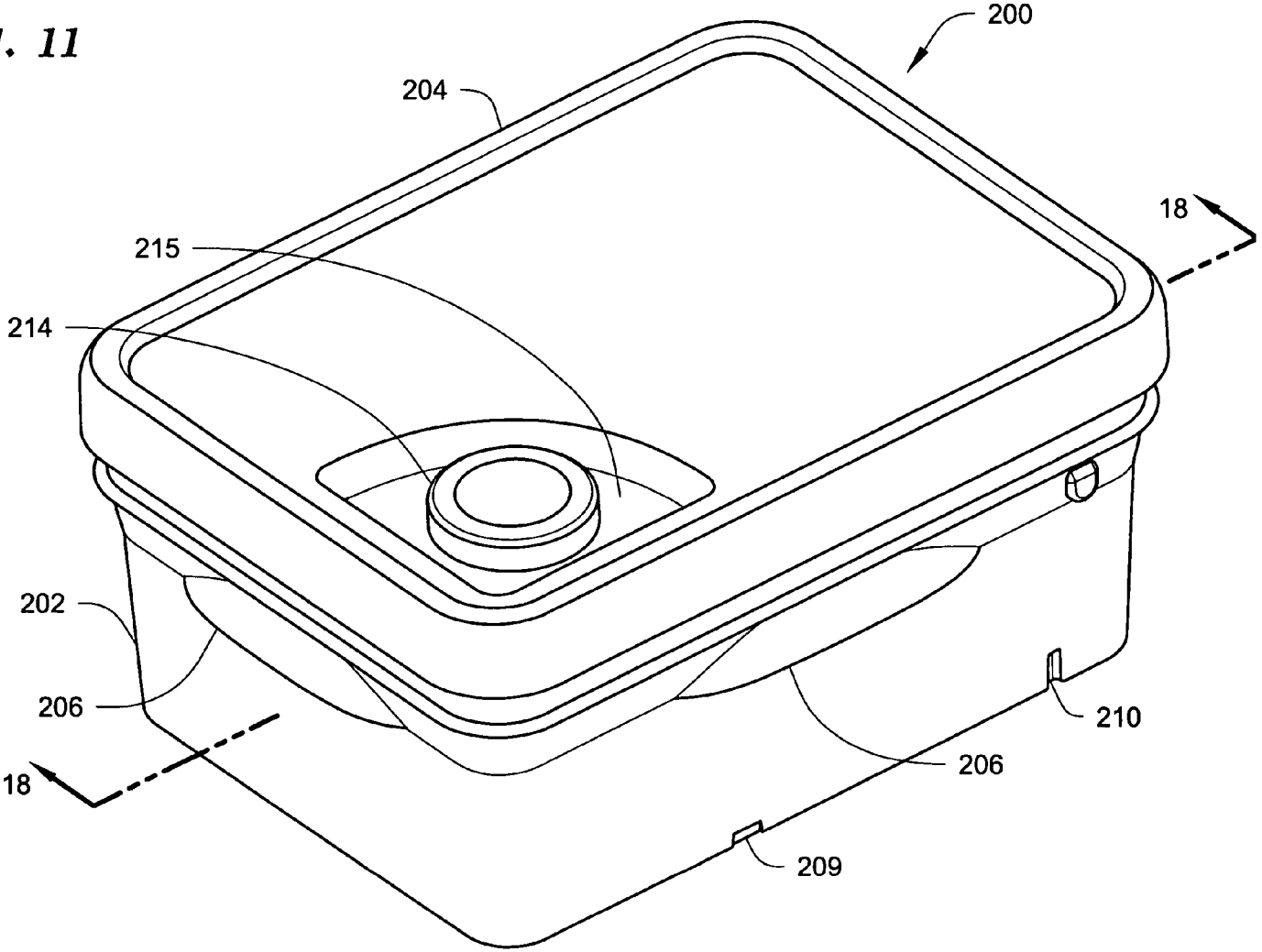
FIG. 11 is a perspective view of a container in accordance with another embodiment of the present invention, the container shown in a closed configuration.

FIGS. 11-19 illustrate yet another embodiment of a liquid, e.g., paint, container in accordance with the present invention. FIG. 11 depicts an exemplary container 200 including a body 202 forming an open top reservoir operable to hold a designated volume of liquid. The open top of the body 202 may be selectively covered and substantially sealed with a removable lid 204. The lid 204 may form a relatively tight seal with the body 202 such that liquid may be shipped and stored within the container 200. When the lid 204 is removed (see FIG. 13), the interior reservoir of the body 202 is accessible.

The container 200 may optionally include one or more protrusions that form handles or handle members 206. The handles 206 may be integrally molded with, or otherwise attached to, the body 202 to permit easy carrying. Preferably, the handles 206, like the handles 106 discussed above, may be positioned on the container 200 such that the containers may be stacked, e.g., for shipping, storage, and display.

Although not shown, the container 200 could also include cutouts similar to cutouts 110 in FIG. 1. However, because of the integral handles 206, such cutouts may be unnecessary in this embodiment.

The lid 204 may include a resealable access opening 214, e.g., an opening with a removable and reusable threaded cap, similar in most respects to the opening 114 (see FIGS. 1 and 8). For example, the opening 214 may allow tinting when the liquid therein is paint. In addition, the opening 214 may function as a pour spout. With respect to the latter, the opening 214 may be located proximate a corner of the lid 204 to permit effective pouring of the liquid from the container 200 while the container is in the closed configuration, i.e., while the lid 204 is in place. The opening 214 may be positioned in a recessed area 215 of the lid 204 such that the recessed area collects liquid that may tend to spill from the opening 214 during pouring. While not illustrated, the recessed area 215 may include features, e.g., small openings in the base of the threaded portion, that permit collected liquid to drain back into the container 200.

As with the container 100, the body 202 and lid 204 may be made of plastic and may seal to one another with a snap fit. To provide improved seal integrity during shipment, the lid 204 may also include a removable lip or tear strip (not shown) surrounding at least a portion of the perimeter of the lid 204.

Figure 12:
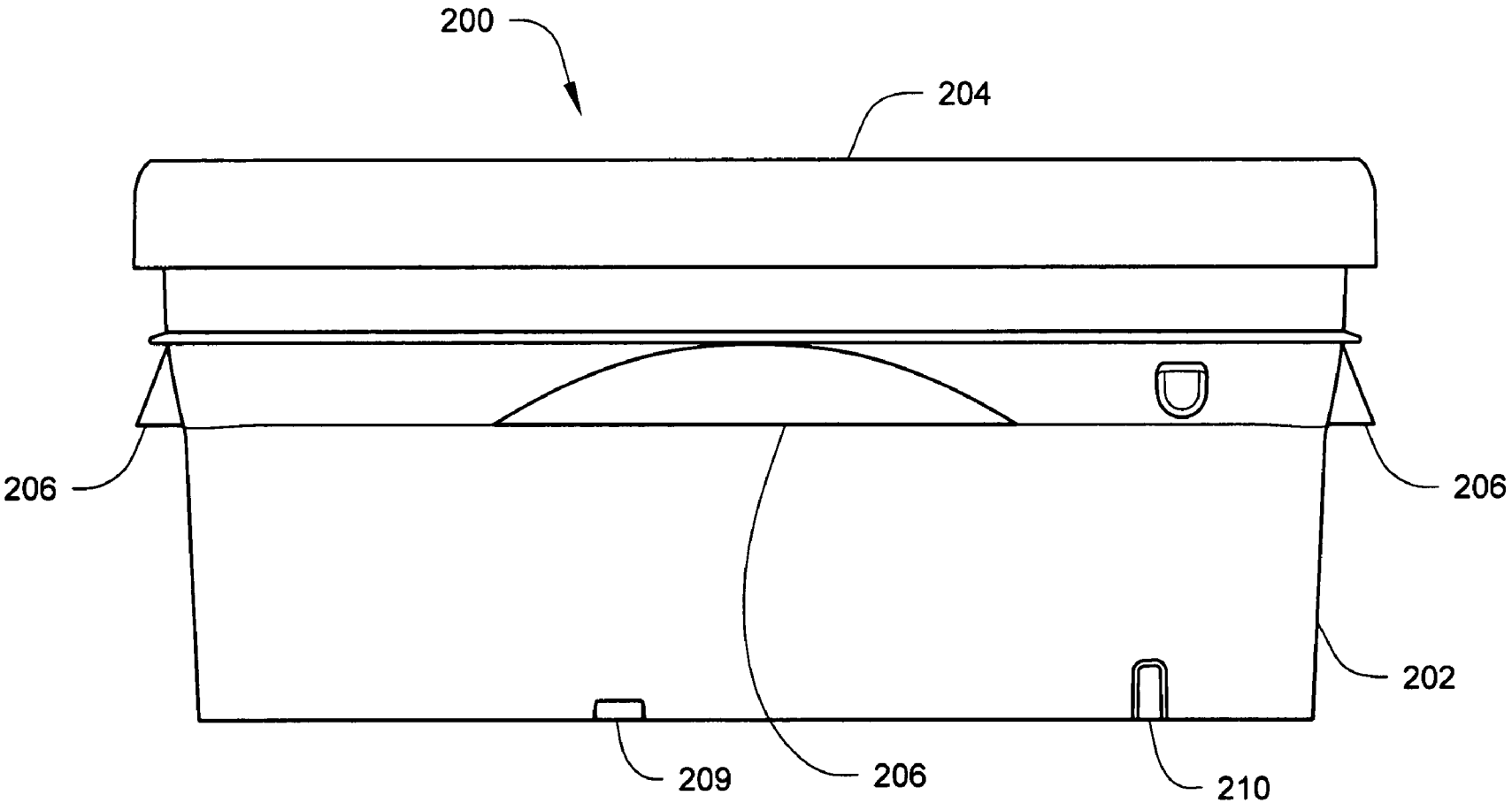
FIG. 12 is a side elevation view of the container of FIG. 11.

FIG. 12 is a side elevation view of the container 200 of FIG. 11. As shown in this view, a handle 206 may be provided on an outer surface of at least one sidewall. FIGS. 11 and 12 further illustrate notches 209 and 210, the purpose of which is further described below.

Figure 13:
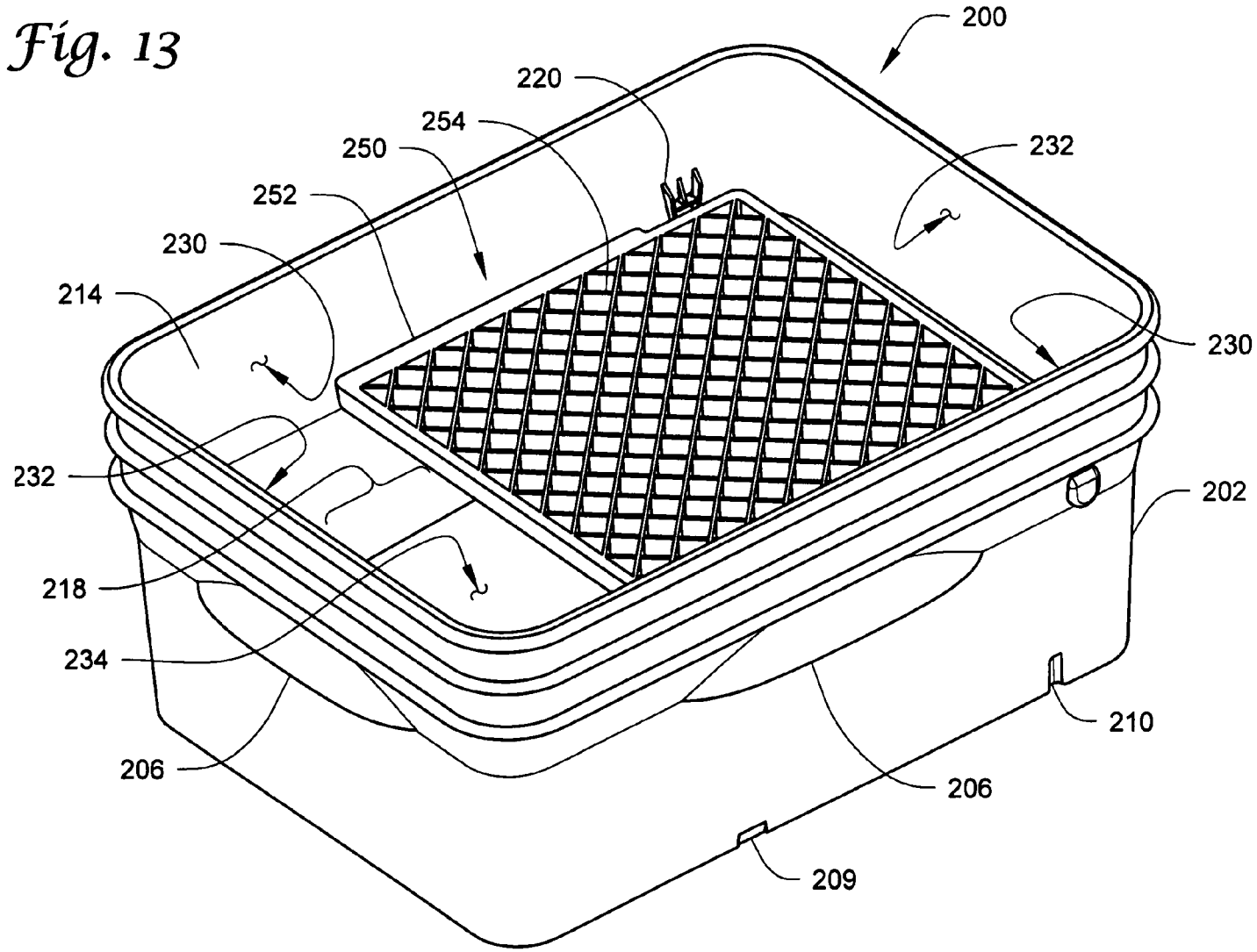
FIG. 13 is a perspective view of the container of FIG. 11 with the container shown in an open configuration (with the lid removed), and an exemplary roller apparatus shown in a first position, the roller apparatus having a roller surface.

FIG. 13 illustrates the container 200 in an open configuration, e.g., with the lid 204 of FIGS. 11-12 removed. As illustrated in this view, the body 202 may include at least two pairs of opposing sidewalls 230 and 232 and a lower surface or floor 234. Once again, while the embodiment illustrated has multiple sidewalls, containers having a single sidewall, e.g., round or elliptical containers, are also contemplated. In FIG. 13, a roller apparatus 250 is also illustrated in a first or operational position. The apparatus 250 includes a roller surface 254 and an optional frame 252 for supporting the roller surface. The apparatus 250 is similar in many respects to the roller apparatus 150 described above, see, e.g., FIG. 6.

Like the surface 154, the surface 254 may be formed by a wire mesh or screen that provides an aggressive pattern to adequately distribute liquid over the surface of a roller-type applicator. However, the surface 254 preferably does not interfere with the flow of excess liquid back into the container body 202. Although shown as using a screen, most any surface that distributes liquid over the roller-type applicator and allows flow of excess liquid back to the container 200 is possible without departing from the scope of the invention.

The apparatus 250 may attach to the body 202 in a manner similar to that described in the embodiment of FIGS. 3-5. That is, the roller apparatus 250 may be secured relative to the sidewalls 230, 232 by tabs 220, 222 as shown in FIGS. 13-15 and 17. The roller surface 254 preferably spans substantially between sidewalls 230 but terminates at distance away from at least one sidewall 232 to provide an access zone 218 for accessing the liquid in the container by a roller-type applicator (see, e.g., applicator 170 of FIG. 8).

Figure 15:
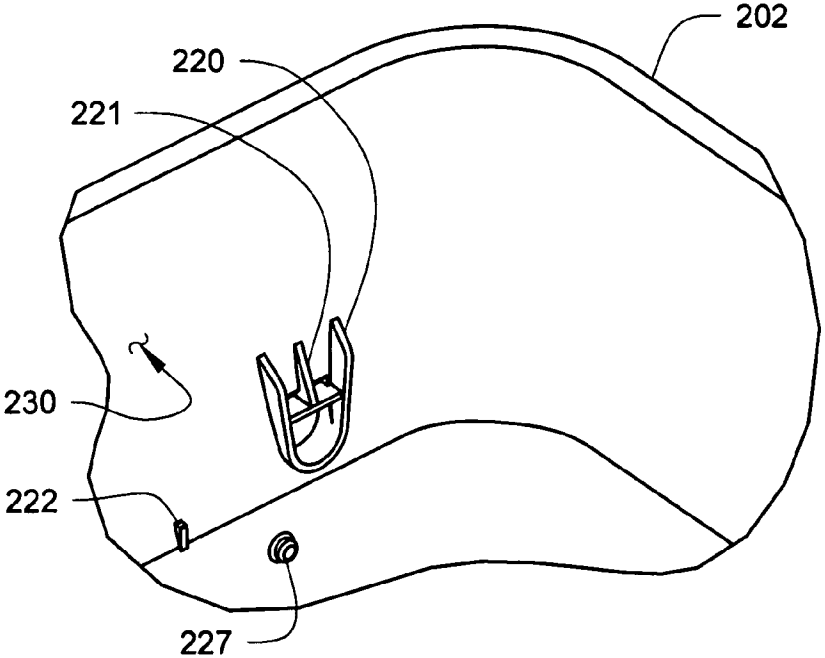
FIG. 15 is a view of the portion of the container of FIG. 14 with the roller apparatus removed for clarity.
Figure 14:
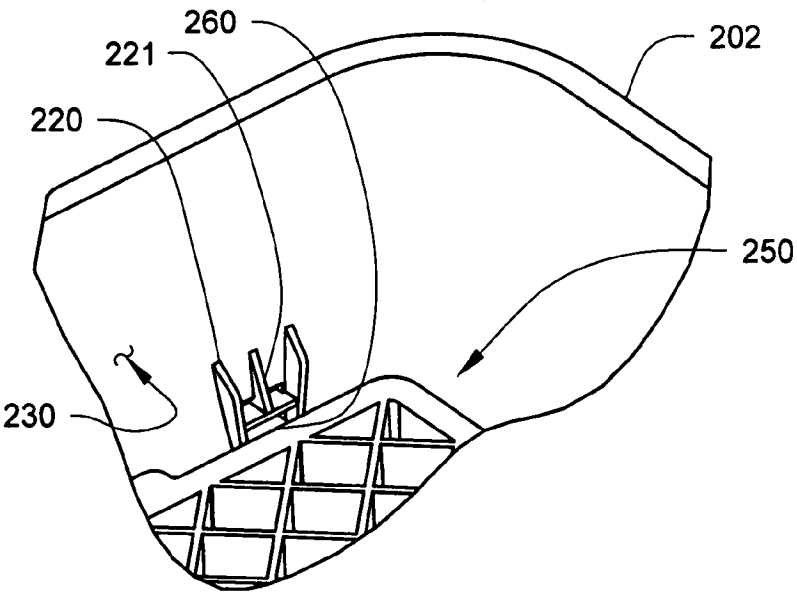
FIG. 14 is a partial enlarged view of a portion of the container of FIG. 13.
Figure 16:
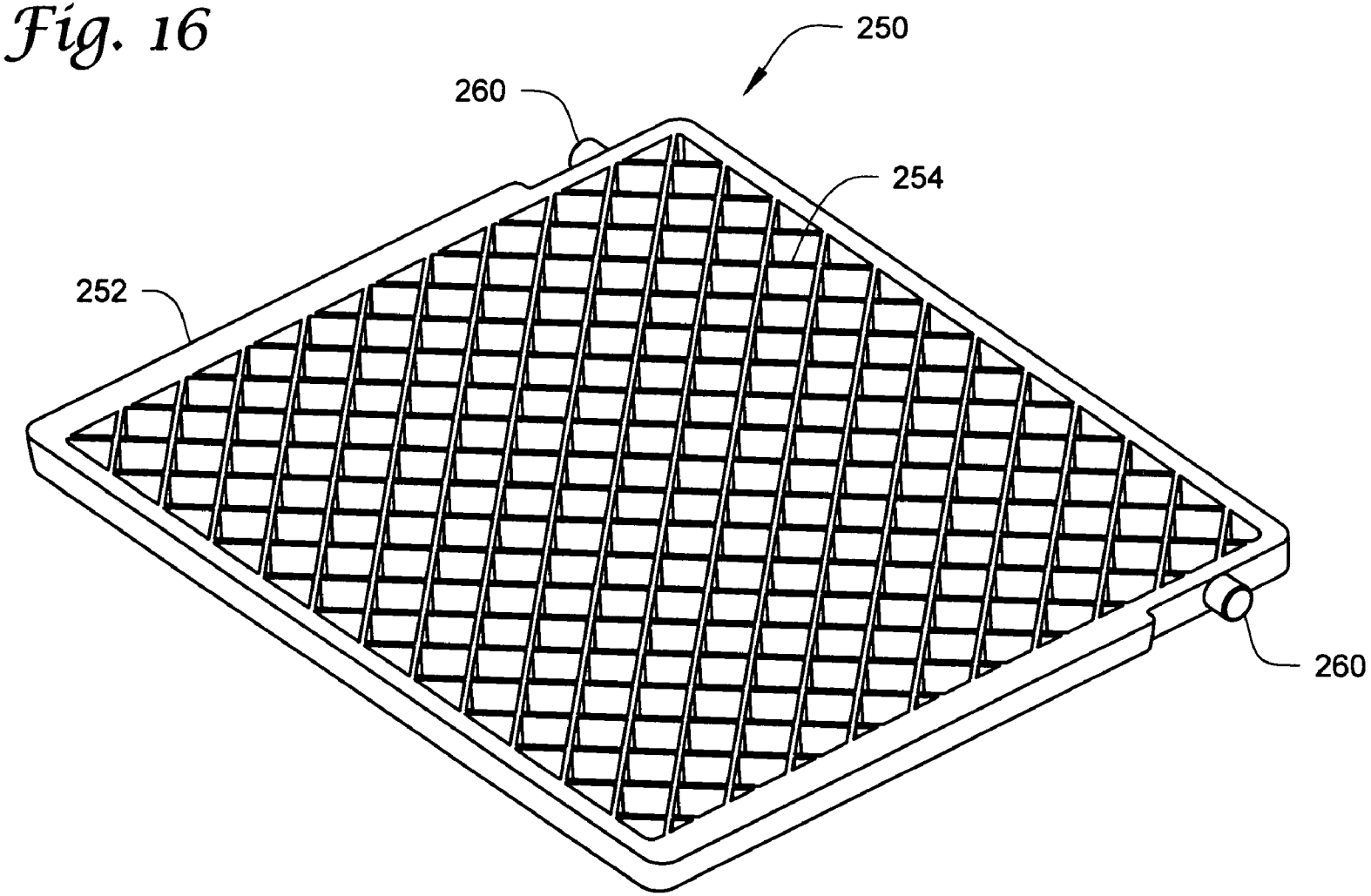
FIG. 16 is a perspective view of the roller apparatus of FIG. 13.

The apparatus 250, e.g., frame 252, may engage the pivot tabs 220 of the body 202 as shown in FIGS. 14-16 (while only one interior sidewall 230 is illustrated in these figures, the opposite sidewall may be a substantial mirror image). Like the embodiments described above (see, e.g., FIGS. 4-5), the apparatus 250 may include pin portions 260 operable to engage the tabs 220. Each pin 260 may engage its respective pivot tab 220 with or without a snap fit. In the illustrated embodiment, each pivot tab 220 forms a generally semicircular-shaped receptacle (see FIG. 15) operable to receive the respective pin 260. A retaining tab 221 may capture the pin 260 upon entry of the pin into the receptacle formed by the pivot tab 220. That is, as each pin 260 is inserted, the retaining tab 221 and/or the body 202 of the container may deform until the pin "snaps" into place, trapping each pin 260, and thus the apparatus 250, in place.

In the illustrated embodiments, the support tabs 222 (FIGS. 15 and 17) may be placed at one or more locations along the sidewalls 230 to form stop members, e.g., form a shelf, that supports the apparatus 250, e.g., the surface 254, in the first operational position as shown in FIG. 13.

Figure 17:
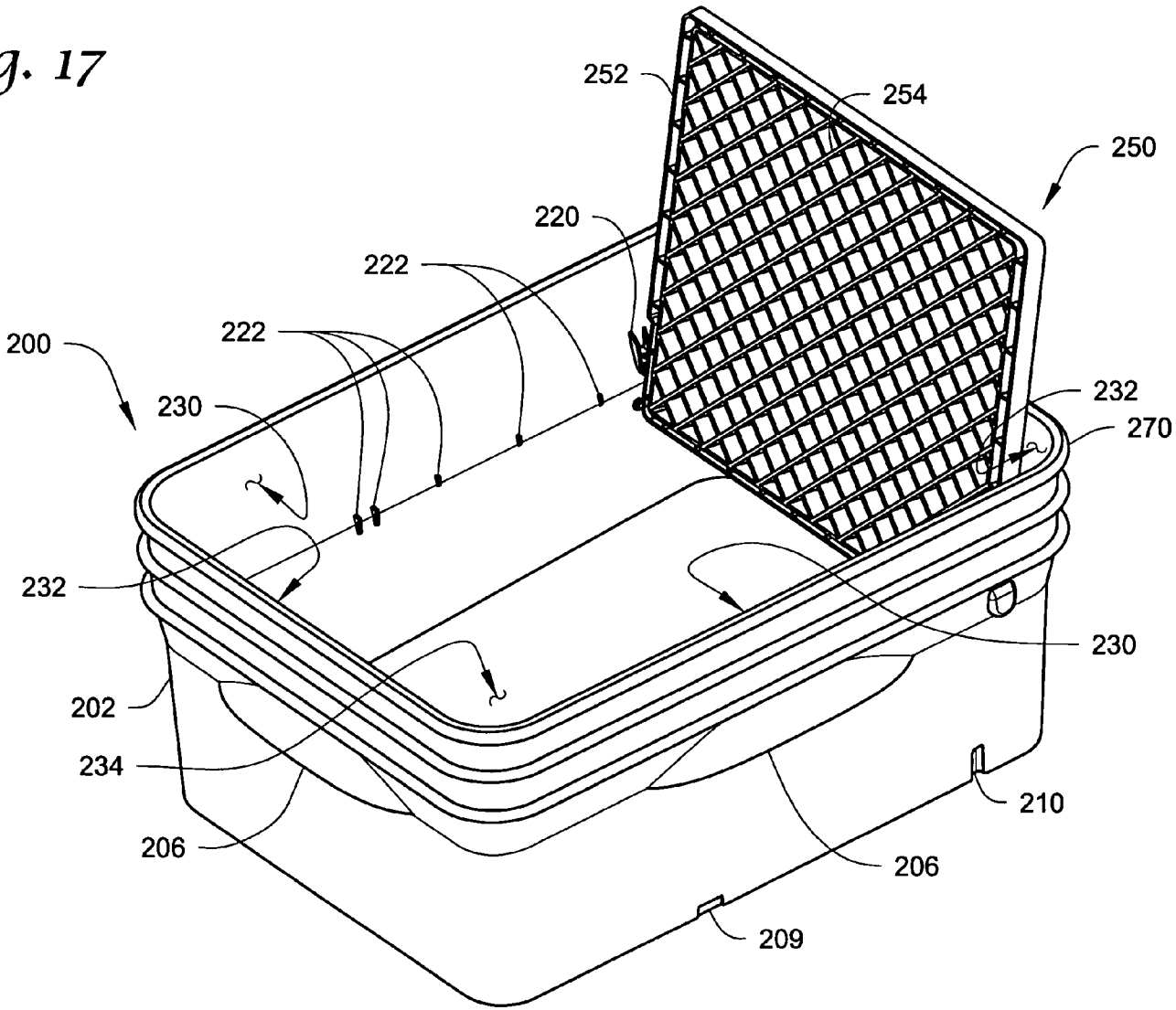
FIG. 17 is a perspective view of the container of FIG. 13, with the roller apparatus shown in a second position.

As with the embodiments described above, the roller apparatus 250, e.g., the surface 254, may pivot to a second open position as shown in FIG. 17. To limit the pivotal movement of the apparatus 250, one or both sidewalls 230 may include a stop member, e.g., a protrusion 227 (see FIG. 15), that contacts or supports the apparatus, e.g., the surface 254, in the second open position. The ability to pivot the apparatus 250 to the second position of FIG. 17 allows the user to access the floor 234 of the body 202 when desired.

The location of the second position of the roller apparatus 250 is selected to ensure that liquid dripping from the apparatus reenters the container 200 rather than dripping onto surrounding surfaces. In certain embodiments, the apparatus 250 pivots about 100 degrees between the first position (FIG. 13) and the second position (FIG. 17). However, other embodiments may pivot more or less as the particular container configuration requires.

FIG. 17 further illustrates the notches 209 and 210, which may be provided and configured to allow stacking of empty container bodies 202. For example, when a first container body 202 is stacked or nested within a second container body 202, the notches 209 (one on each side of the container body) of the first container body engage the tabs 222 of the second container body while the notches 210 engage the corresponding tabs 220. As a result, container bodies 202 may be stacked (when empty and the apparatus 250 is removed) without excessive friction locking between the bodies.

Figure 18:
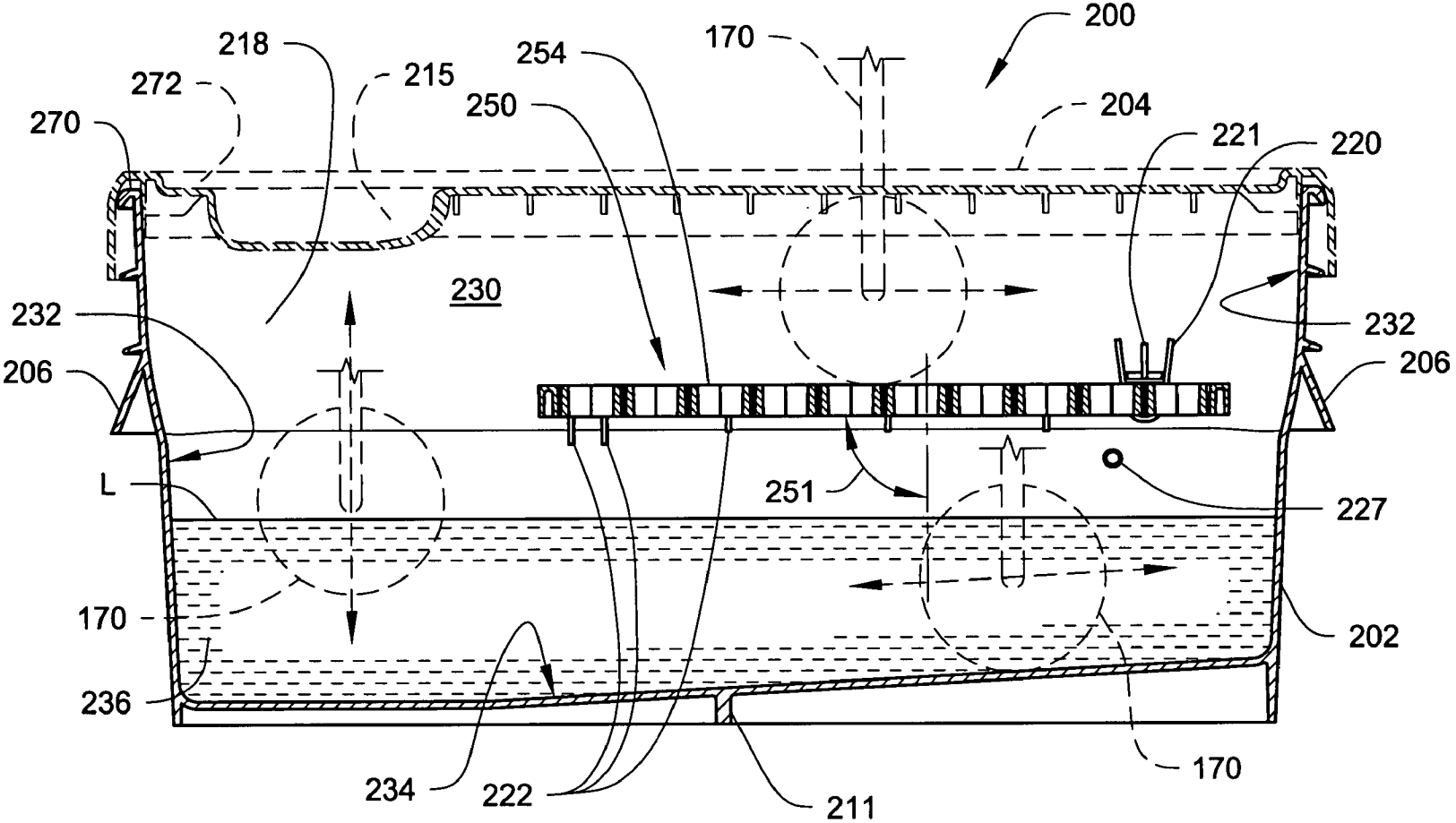
FIG. 18 is a section view taken along line 18-18 of FIG. 11 with an opening of the lid shifted to center to appear in section.

FIG. 18 is a section view taken along line 18-18 of FIG. 11 (the recessed area 215 is shifted towards the center of the lid 204 in this view to appear more clearly in section). In this view, the orientation of the roller apparatus 250 is shown as being positioned at an angle 251 from an imaginary vertical line (i.e., an axis substantially normal to the level of the liquid L) to assist with liquid return to the body 202. The angle 251 may be similar in magnitude to angle 151 (see FIG. 8) already described herein.

Like the apparatus 150, the roller surface 254 of the apparatus 250 is preferably located such that a substantial portion remains at or preferably above the designated level of the liquid L in the container 200. In the illustrated embodiment, the lowermost portion of the roller surface 254 may be positioned above the designated level of liquid L, while an uppermost portion of the roller surface 254 may be below an uppermost edge 270 of the body 202.

FIG. 18 also illustrates the floor 234 of the body 202. Once again, a well 236 may be formed to collect liquid L below the access zone 218. At least a portion of the floor 234 may also be sloped as shown to allow liquid L to flow towards the well 236. By keeping liquid in the well 236, the user may wet the roller-type applicator more easily through the access zone 218 during use without the need to tip or otherwise manipulate the container 200.

As with the container 100, the floor 234 may also include a roller surface, e.g., a surface having protrusions, so that, as the volume of liquid L gets low, the actual floor 234 may be utilized as a second roller surface. While the floor 234 may be sloped and/or include the well 236 to assist in pooling of the liquid L, other embodiments may optionally use a flat, e.g., horizontal, floor. Moreover, while the floor 234 may include some sort of protrusions, it may also form a relatively smooth roller surface as shown in the figures, see, e.g., FIGS. 17 and 18.

Figure 19:
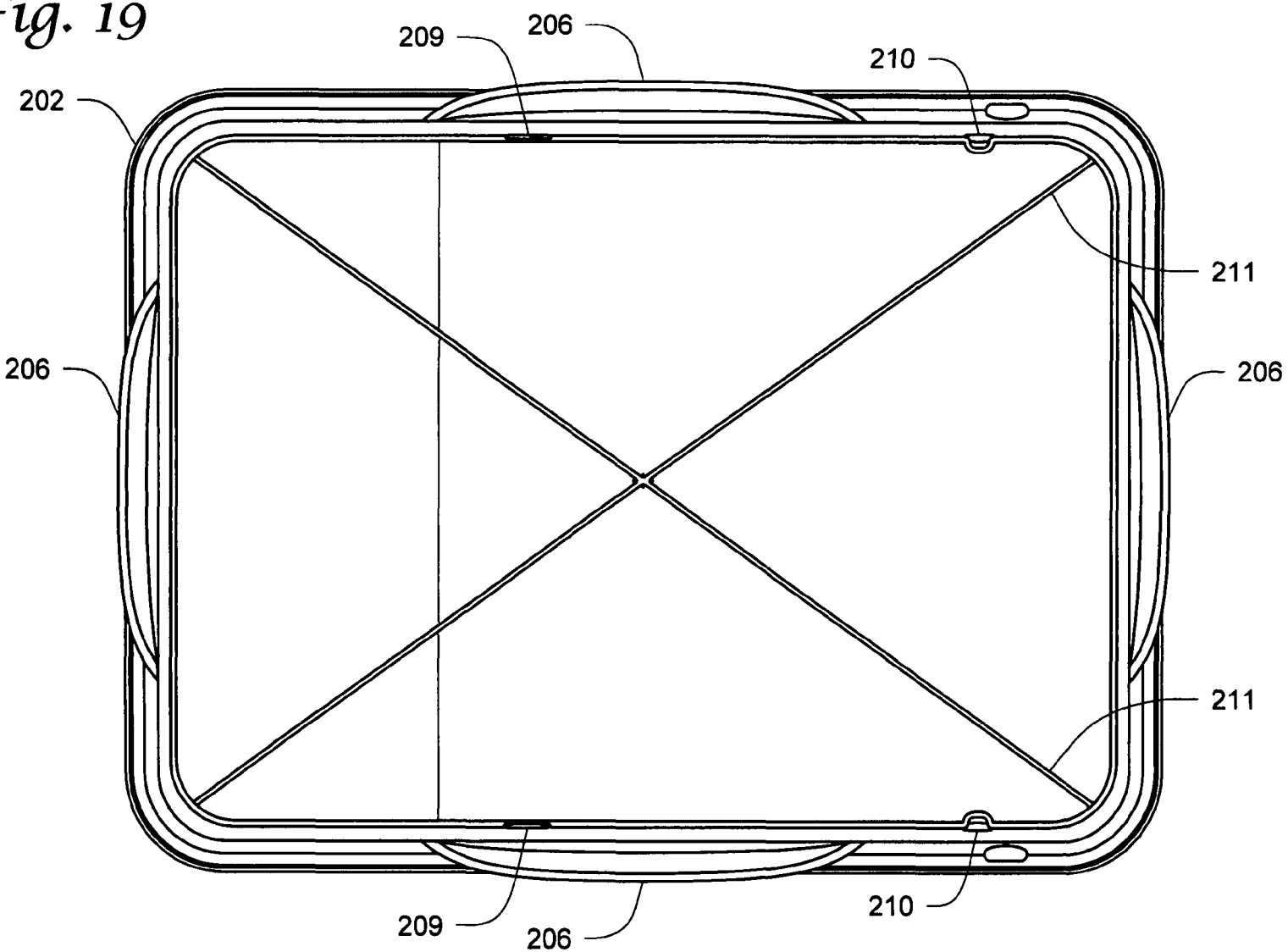
FIG. 19 is a bottom plan view of the container of FIG. 11.

The underside of the body 202 may also include one or more ribs like the ribs 111 of FIG. 2. Alternatively, as shown in FIG. 19, a first support rib 211 and a second support rib 211 may extend beneath the floor 234 and approach one another proximate the center of the container body, e.g., they may converge in such a way that the first support rib and the second support rib form a generally X-shaped support structure. The ribs 211 are preferably recessed slightly from the peripheral edge of the bottom of the container body 202 so that, when the containers are stacked, the ribs 211 do not substantially rub the upper surface of the lid 204 of the container 200 directly underneath. As a result, damage to the lid 204 from stacking may be minimized. While particular rib structures are described herein, those of skill in the art will appreciate that most any configuration is possible without departing from the scope of the invention.

As FIG. 18 illustrates, the bottom of the containers 200 may be shaped to be received within a recessed portion 272 of the lid 204. Accordingly, the containers (when sealed) tend to nest or self-center when stacked upon one another.

In use, the container 200 operates substantially the same as the container 100 described above. For example, a roller type applicator 170 may be dipped into the liquid L through the access zone 218 as shown by one of the broken line representations of the applicator 170 in FIG. 18. After the applicator 170 is wetted, it may be rolled along the roller apparatus 250 (e.g., the surface 254) as illustrated in FIG. 18. Optionally, as the volume of liquid L in the container diminishes, the apparatus 250, e.g., the surface 254, may be moved to its second position (see FIG. 17), whereby the applicator 170 may be dipped and subsequently rolled along the floor 234 as shown in FIG. 18.

Exemplary embodiments of the present invention are described above. Those skilled in the art will recognize that many embodiments are possible within the scope of the invention. Other variations, modifications, and combinations of the various parts and assemblies can certainly be made and still fall within the scope of the invention. Thus, the invention is limited only by the following claims, and equivalents thereto.

What is claimed is:

1. A container, comprising:

a one-piece container body comprising a sloped floor and at least one pair of opposing sidewalls, the sloped floor and the at least one pair of opposing sidewalls defining a reservoir operable to hold a designated volume of liquid;

a lid to cover an open top of the container body and to form a relatively tight seal therewith; and a perforated first roller surface pivotally coupled to the at least one pair of opposing sidewalls, the first roller surface being pivotable between a first position and a second position, wherein, when the first roller surface is in the first position, a substantial portion of the first roller surface is located within the reservoir above the designated volume of liquid and substantially between the at least one pair of opposing sidewalls.

2. The container of claim 1, wherein a lowermost portion of the first roller surface is located above the designated volume of liquid.

3. The container of claim 1, further wherein the first roller surface is, when the first roller surface is in the first position and the lid is covering the open top of the body, located within an enclosed space defined by the container body and the lid.

4. The container of claim 3, wherein the lid comprises an access opening.

5. The container of claim 4, wherein the access opening comprises a pour spout.

6. The container of claim 1, wherein the container body comprises a pour spout.

7. The container of claim 1, wherein the first roller surface further comprises a frame.

8. The container of claim 1, wherein the sloped floor is inclined towards a first end of the container body such that a well is formed proximate the first end.

9. The container of claim 1, wherein the first roller surface is located, when in the first position, about 70 degrees to about 110 degrees from vertical.

10. The container of claim 1, wherein the container body comprises a stop member operable to support the first roller surface in the first position.

11. The container of claim 1, wherein the container body comprises a stop member operable to support the first roller surface in the second position.

12. The container of claim 1, wherein the sloped floor comprises a second roller surface.

13. The container of claim 1, wherein the container further comprises one or more handle members.

14. The container of claim 13, wherein the one or more handle members comprises one or more wire handles pivotally coupled to the container body.

15. The container of claim 13, wherein the one or more handle members comprises one or more protrusions on the container body.

16. The container of claim 1, further comprising a first support rib and a second support rib both extending beneath the sloped floor, wherein the first support rib and the second support rib approach one another proximate the center of the container body.

17. The container of claim 16, wherein the first support rib and the second support rib form a generally X-shaped support structure.

18. The container of claim 1, wherein the at least one pair of opposing sidewalls comprise tabs to pivotally receive the first roller surface.

19. The container of claim 1, wherein the first roller surface is operable to pivot about a pivot axis passing through the pair of opposing sidewalls.

20. An article, comprising:

a designated volume of liquid; and a container comprising:

a container body for receiving and storing the designated volume of liquid, wherein the container body comprises a plurality of sidewalls and a floor, the plurality of sidewalls defining an opening of the container body;

a removable and resealable lid operable to form a relatively tight seal with the container body and to selectively cover the opening; and a perforated first roller surface pivotally coupled to the container body and positioned between two or more sidewalls of the plurality of sidewalls, wherein the first roller surface is, when in a first position, located above the designated volume of liquid and below an uppermost edge of the container body.

21. The article of claim 20, wherein the first roller surface is movable, relative to the container body, between the first position and a second position.

22. The article of claim 20, wherein the floor of the container body comprises at least one sloped portion, wherein the sloped portion comprises a second roller surface.

23. A container, comprising:

a one-piece container body defining a partially enclosed reservoir having an open top, the reservoir for receiving and storing a designated volume of liquid;

a first roller surface for distributing liquid over a roller-type liquid applicator, the first roller surface pivotally coupled to the container body, wherein the first roller surface is, when in a first position, located within the reservoir at a level above the designated volume of liquid and below the open top, and is further positioned about 70 degrees to about 110 degrees from vertical; and a selectively removable lid operable to seal the open top.

* * * * *